US005799229A

United States Patent [19]

Yokoyama et al.

[11] Patent Number: 5,799,229

[45] Date of Patent: Aug. 25, 1998

[54] TONER SPREADING DEVICE FOR A CHARGING ROLLER OF AN IMAGE FORMING APPARATUS

[75] Inventors: Masato Yokoyama, Tokyo; Takaya Muraishi; Masumi Sato, both of Yokohama; Hiroshi Saito, Kawasaki; Toshiyuki Uchida, Yokohama, all of Japan

[73] Assignee: Ricoh Company, Ltd., Tokyo, Japan

[21] Appl. No.: 814,361

[22] Filed: Mar. 11, 1997

[30] Foreign Application Priority Data

Mar. 11, 1996 [JP] Japan ..... 8-083316

[51] Int. Cl.[6] ..... G03G 15/02; G03G 21/00

[52] U.S. Cl. ..... 399/100; 399/176

[58] Field of Search ..... 399/100, 150, 399/176, 343, 350, 351; 15/1.51, 256.51, 256.53

[56] References Cited

U.S. PATENT DOCUMENTS

| | | | |
|---|---|---|---|
| 4,334,766 | 6/1982 | Sugiyama et al. . | |
| 4,440,488 | 4/1984 | Maekawa et al. | 399/351 |
| 4,595,280 | 6/1986 | Tanzawa et al. | 15/256.51 X |
| 4,958,197 | 9/1990 | Kinashi et al. | 399/350 |
| 4,999,678 | 3/1991 | Tange | 399/350 X |
| 5,396,319 | 3/1995 | Tokuhashi et al. | 399/351 |
| 5,557,373 | 9/1996 | Miyashita et al. | 399/176 X |
| 5,619,311 | 4/1997 | Kurokawa et al. | 399/176 |

FOREIGN PATENT DOCUMENTS

| | | |
|---|---|---|
| 3-120564 | 5/1991 | Japan . |
| 7-168422 | 7/1995 | Japan . |
| 7-175298 | 7/1995 | Japan . |
| 7-199604 | 8/1995 | Japan . |
| 8-44159 | 2/1996 | Japan . |

*Primary Examiner*—Sandra L. Brase
*Assistant Examiner*—Sophia S. Chen
*Attorney, Agent, or Firm*—Oblon, Spivak, McClelland, Maier & Neustadt, P.C.

[57] ABSTRACT

An image forming apparatus including a photoconductive drum, a charging roller which is held in pressured contact with the photoconductive drum, and a holder which holds a spreading blade having a free or unsupported end which is held in contact with the charging roller to spread toner and other particles which adhere to the surface of the charging roller. Preferably, there is a thin flexible film between the holder and the spreading blade. The spreading blade is held by the holder such that when the charging roller rotates, a frictional force pulls the spreading blade relative to the holder. This frictional force imposes a rotational moment on the spreading blade which reduces the force of the spreading blade against the charging roller when the charging roller rotates. In order to extend the life of the spreading blade and to achieve a uniform distribution of the particles on the charge roller, the spreading blade may be moved in a reciprocating motion along a plane tangential to the surface of the roller and/or along the length of the roller. The spreading blade spreads the toner and other particles which adhere to the surface of the charging roller into a thin uniform layer so that the charging roller uniformly charges the photoconductive drum.

48 Claims, 7 Drawing Sheets

TONER SPREADING DEVICE FOR A CHARGING ROLLER OF AN IMAGE FORMING APPARATUS

BACKGROUND OF THE INVENTION

1. Field of the Invention

The present invention relates to a charging device for an image forming apparatus such as a copier, a printer, a facsimile machine or similar electrophotographic image forming apparatus. More particularly, the invention is concerned with a toner spreading device for a charging roller for the image forming apparatus.

2. Background of the Invention

In an image forming apparatus, residual toner is removed from a photoconductive drum by a cleaning device. However, a small quantity of toner on the photoconductive drum is not removed by the cleaning device, and this toner adheres to the surface of a charging roller. Further, scattered toner in the image forming apparatus also adheres to the surface of the charging roller. The adhered toner influences charging quality. Namely, if the toner on the surface of the charging roller is not uniform, a quantity of charge on the photoconductive drum is not uniform.

In order to solve the aforementioned drawbacks, a conventional charging roller for the image forming apparatus has a cleaning device which is held in pressured contact with the surface of the charging roller to remove residual toner on the charging roller. In such an image forming apparatus, the cleaning device is held in contact with the surface of the charging roller with a strong force to remove the residual toner on the surface of the charging roller. Because of the strong force, a filming phenomenon on the surface of the charging roller occurs, and the surface of the charging roller and contact portion of the cleaning device become damaged over time. The filming phenomenon results from wax which is contained in the toner and adheres to the charging roller due to a strong pressure of the cleaning device against the charging roller. The filming phenomenon changes the resistance value of the charging roller and the wax layer is difficult to clean from the charging roller.

In order to solve the aforementioned drawbacks, it is known to keep the cleaning device separated from the surface of the charging roller during a non-cleaning operation period of time. However, this cleaning device is complex in structure and therefore increases costs and increases the likelihood of failure. Further, conventional cleaning devices of the charging roller cannot easily maintain a desired pressure against the charging roller.

SUMMARY OF THE INVENTION

Accordingly, it is an object of the present invention to provide a charging device for an image forming apparatus that solves the aforementioned drawbacks.

It is another object of this invention to provide a device which uniformly spreads contaminants on the charging roller so that the charging roller uniformly charges an image bearing member.

These and other objects are achieved according to the present invention by providing a novel image forming apparatus including a photoconductive drum, a charging roller which is held in pressured contact with the photoconductive drum, a spreading blade having a free end which is held in contact with the charging roller to spread toner which adheres on the surface of the charging roller, and a holder which supports the spreading blade. The spreading blade and the holder thereof are arranged such that when the charging roller is rotating in the direction ordinarily used during the image forming process, the free end of the spreading blade experiences a frictional force from the rotation of the charging roller which results in a pulling force which pulls the spreading blade away from the holder. However, the spreading blade is not actually pulled from the holder. With this arrangement, there is an acute angle formed having a vertex at a point of contact between the spreading blade and the charging roller, has one side formed by the spreading blade, and the other side formed by a line which is tangent to the charging roller at the vertex and extends over an unspread portion of the charging roller.

Because of the relative positions of the charging roller, spreading blade, and holder, a frictional force which acts on the spreading blade due to the rotation of the charging roller imposes a rotational moment or force on the spreading blade. The point of rotation of the spreading blade is where the spreading blade contacts the holder. This rotational force imposed on the spreading blade reduces the force of the spreading blade against the charging roller.

In order to extend the life of the spreading blade and to provide a more uniform spreading of particles on the charging roller, the spreading blade may be moved in a reciprocating motion. One type of motion which may be imposed on the spreading blade moves the spreading blade towards and away from the charging roller along a plane substantially parallel to the plane tangent to the cylindrical surface of the charging roller at the point of contact. This movement may be accomplished through the use of an eccentric cam which rotates in a plane substantially parallel to the blade.

Alternatively, the spreading blade may be moved back and forth along a line parallel to a length of the charging roller. This reciprocating motion may be imposed by a rotating cylindrical member having a spiral groove therein. A protrusion which is connected to the holder is disposed within the spiral grooves and moves the spreading blade back and forth as the cylindrical member rotates. As an alternative to using the spiral groove, a rotatable member may be utilized which has a circular contact surface with a substantially constant radius and is tilted with respect to an axis of rotation of the rotatable member. As the rotatable member rotates, a contact portion, connected to the holder, moves back and forth, thus moving the spreading blade back and forth along the length of the roller.

The pressure of the spreading blade against the charging roller is preferably between 0.5 and 5 gf/cm. In the preferred embodiment of the invention, there is a flexible film having an area which is substantially equal to an area of a top side of the spreading blade mounted between the holder and the spreading blade.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 3A illustrates a force N of the spreading blade acting on the charging roller when the charging roller is not rotating. FIG. 3B includes a frictional force F which acts on the spreading blade when the charging roller rotates. FIG. 3C illustrates a rotational moment R which results from the frictional force F, and FIG. 3D illustrates a force N' which results from the summation of the rotation moment R and the force N;

DESCRIPTION OF THE PREFERRED EMBODIMENTS

Figure 1:
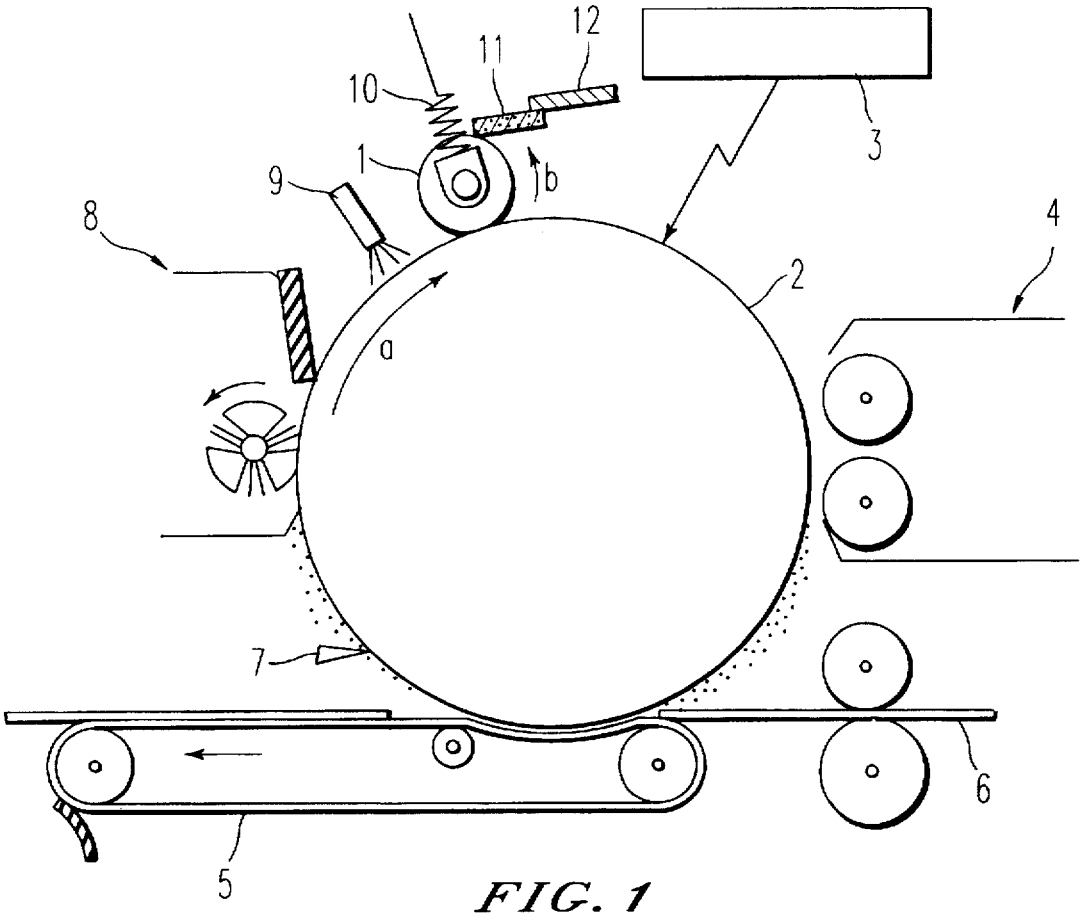
FIG. 1 is a cross-sectional view of an image forming apparatus of the present invention.

Referring now to the drawings, wherein like reference numerals designate identical or corresponding parts throughout the several views, and more particularly to FIG. 1 thereof, there is illustrated an electrophotographic image forming apparatus embodying the present invention. The electrophotographic image forming apparatus includes a charging roller 1 which is held in pressured contact with a photoconductive drum 2. The photoconductive drum 2 rotates in a direction indicated by an arrow a and is charged by the charging roller 1. The photoconductive drum 2 is then exposed by an exposing device 3 which may be any type of exposing device including an array of light emitting diodes (LEDs), or a laser beam exposing device which uses a laser and a rotating polygonal mirror to form an electrostatic latent image on the photoconductive drum 2.

Since the charging roller 1 is held in pressured contact with the photoconductive drum 2, the charging roller 1 rotates in a direction indicated by an arrow b due to a rotational force received from the photoconductive drum 2. The electrostatic latent image is developed by toner from a developing device 4 which adheres on an exposed surface of the photoconductive drum 2. The toner image is then transferred to a sheet of paper 6 by a transferring device 5. The transferring device 5 can be implemented as illustrated using a transfer belt which is charged, or alternatively using a charged roller. Residual toner 7 on the photoconductive drum 2 is removed from the photoconductive drum by a cleaning device 8. A discharging lamp 9 discharges a residual charge on the photoconductive drum 2.

Figure 2:
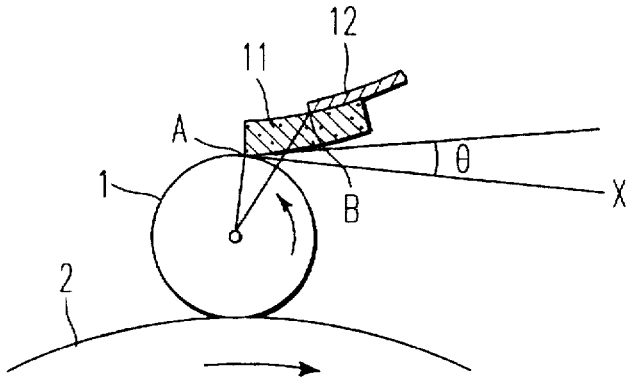
FIG. 2 is an enlarged cross-sectional view of a photoconductive drum, a charging roller, and a spreading device which are illustrated in FIG. 1.

The charging roller 1 is held in pressured contact with the surface of the photoconductive drum 2 by a pressure spring 10. A small quantity of the residual toner 7 cannot be removed by the cleaning device 8 and it passes through the cleaning device 8. This toner subsequently adheres to the surface of the charging roller 1 at a contact point between the charging roller 1 and the photoconductive drum 2. A small quantity of scattered toner in the image forming apparatus also adheres to the surface of the charging roller 1. The toner adhering to the surface of the charging roller 1 influences the charging quality which the charging roller 1 imposes on the photoconductive drum 2. In order to prevent serious problems from resulting by the particles adhering to the charging roller 1, there is a spreading blade 11 which is held in pressured contact with the surface of the charging roller 1 to spread the adhered toner on the surface of the charging roller 1 uniformly. As illustrated in FIG. 2, the spreading blade 11 is supported by a holder 12 using an adhesive, for example, such that an angle θ between the spreading blade 11 and a line X which is tangent to the contact point A and is an acute angle (an angle less than 90°). The line X illustrated in FIG. 2 extends over an unspread portion of the charging roller, meaning that this portion of the charging roller may have picked up particles from the photoconductive drum 2 which have not yet been spread or contacted by the spreading blade 11.

A portion of the spreading blade 11 which contacts the charging roller 1 at point A is considered to be a free end of the spreading blade. Further, the opposite end of the spreading blade which is preferably glued to the holder 12 is opposite to the free end. When the charging roller 1 rotates in the ordinary direction which is used for the image forming process, a frictional force acts on the spreading blade 11. This frictional force pulls the spreading blade 11 and urges the spreading blade 11 away from the holder 12. This pulling or urging force is not sufficient to pull the spreading blade 11 away from the holder 12.

By the spreading blade 11 uniformly spreading the adhered toner on the surface of the charging roller 1, a thin uniform toner layer is formed on the surface of the charging roller 1. This thin uniform toner layer causes the quantity of charge from the charging roller 1 which is imposed on the photoconductive drum 2 to be uniform. The spreading blade 11 is made of an elastic material such as polyurethane foam, rubber, felt, or any other suitable material which spreads the toner and is supported by a holder 12.

As shown in FIG. 2, a supporting point B that is a leading edge portion of the holder 12 is provided downstream of a contacting point A with respect to a rotating direction of the photoconductive drum 2 and upstream with respect to a rotating direction of the charging roller 1. The effect of the arrangement of the holder 12, spreading blade 11, and rotating direction of the charging roller 1 is explained in FIGS. 3A–3D.

Figure 3B:
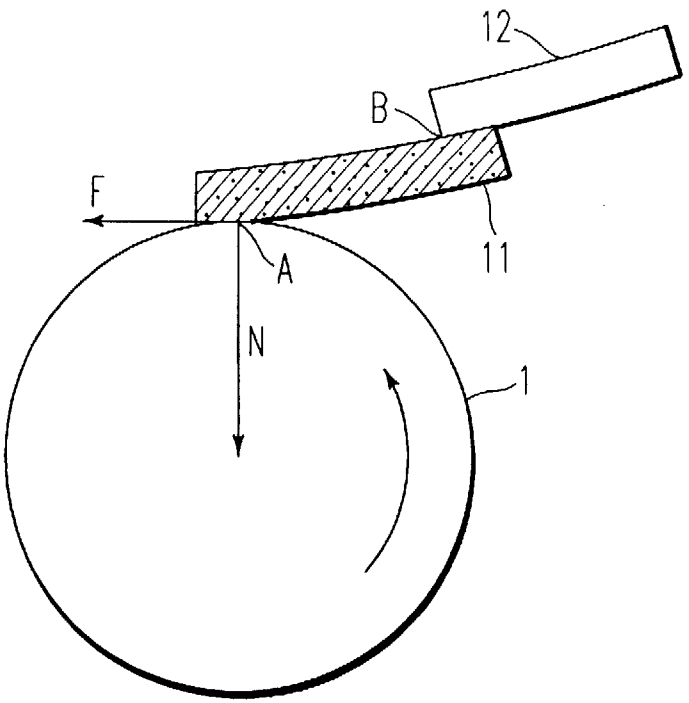
FIGS. 3A–3D are views of the forces acting between the spreading blade and the charging roller.
Figure 3A:
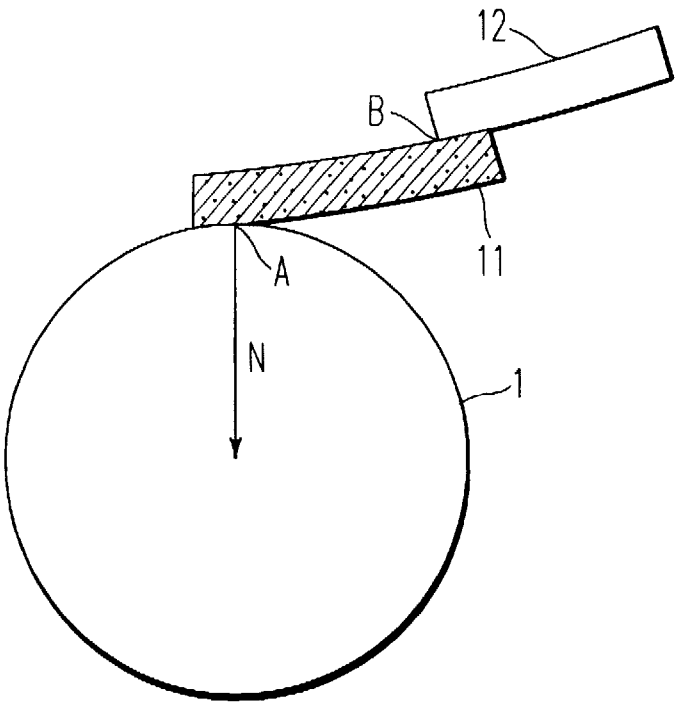
Figure 3D:
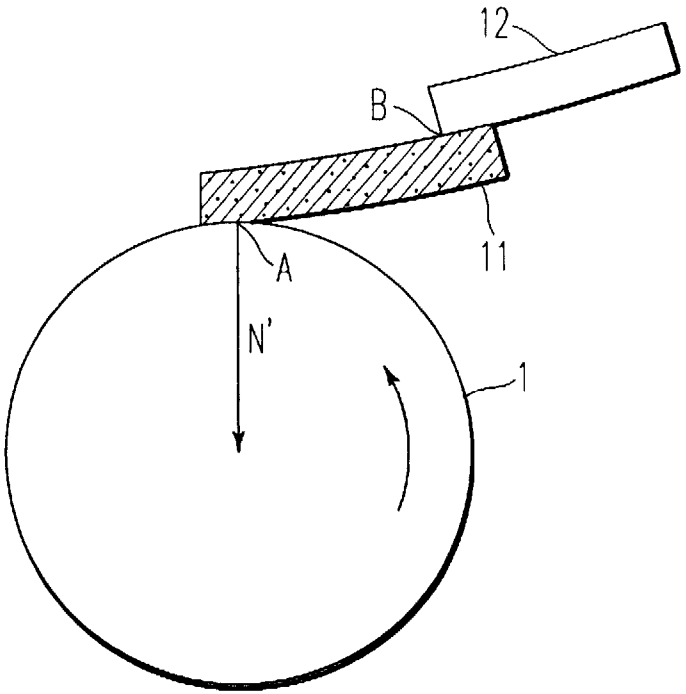
Figure 3C:
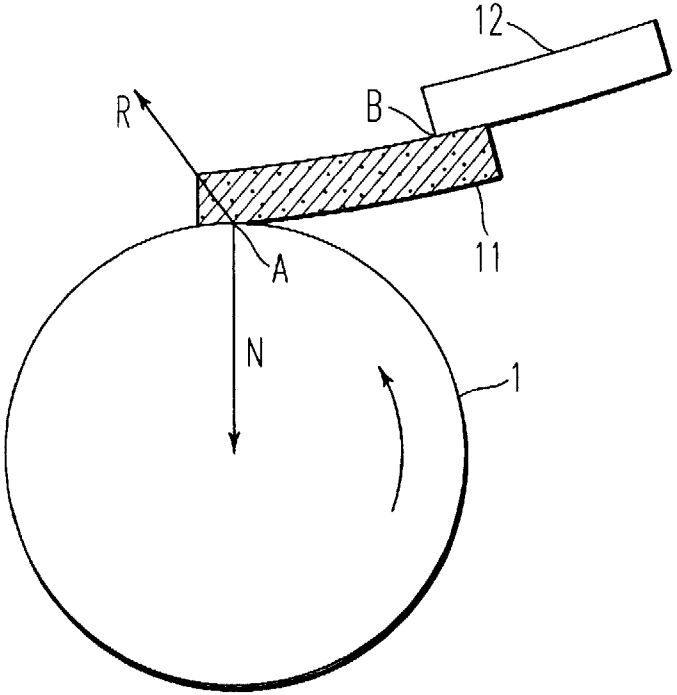

FIG. 3A illustrates a state in which the charging roller 1 is not rotating. In this case, there is a force N of the spreading blade 11 acting on the charging roller 1 at point A. When the charging roller 1 rotates in a counter-clockwise direction as illustrated in FIG. 3B, the spreading blade 11 experiences a frictional force F which tends to urge the spreading blade 11 away from the holder 12. However, point B is the effective supporting point of the spreading blade 11 and the force F imposed on the spreading blade 11 when the spreading blade 11 is supported at point B results in a rotational moment R as illustrated in FIG. 3C. Summing the vertical component of the rotational moment R with the force N has a net result of a force N' as illustrated in FIG. 3D. Thus, when the charging roller 1 rotates in the counter-clockwise direction and the spreading blade 11 is supported as illustrated in the Figures, the force of the spreading blade 11 against the charging roller 1 is reduced. This reduction in force is opposite to what happens when the charging roller 1 rotates in the clockwise direction. The reduction in force of the spreading blade 11 against the charging roller 1 when the charging roller rotates in the counter-clockwise direction is advantageous in that a relatively light force of the spreading blade 11 can be achieved against the charging roller 1. However, if an arrangement such as that utilized in FIGS. 2 and 3A–3D is not utilized, it becomes difficult to accurately obtain a small force of the spreading blade 11 against the charging roller 1. Thus, the arrangement utilized by the invention has a distinct advantage over other structural arrangements which are not similar to the present invention.

Figure 4:
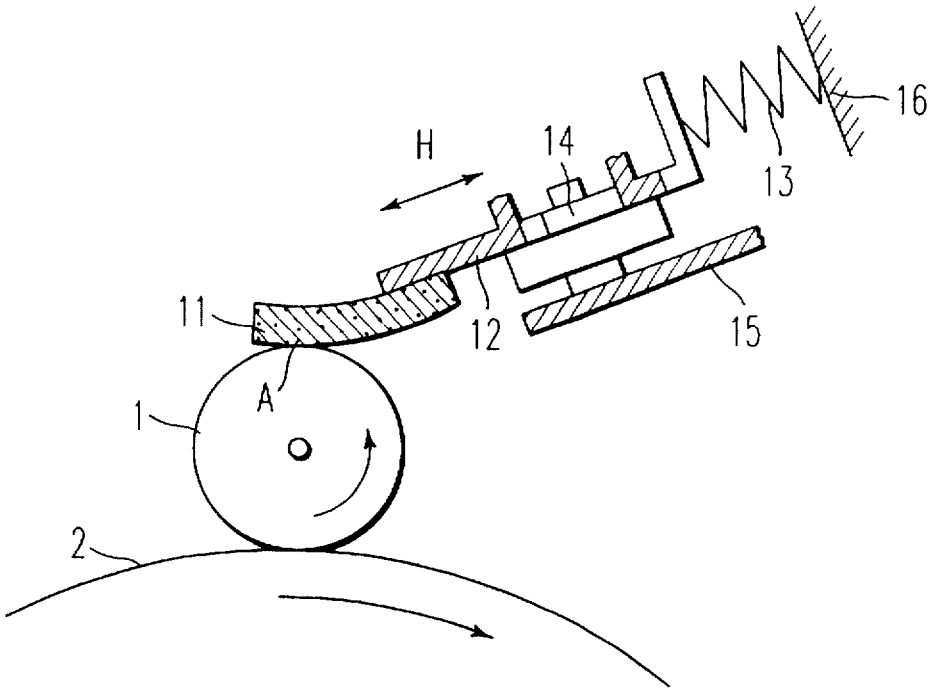
FIG. 4 is a cross-section view of a supporting device for a holder of the spreading blade according to a modified embodiment of the invention.
Figure 5:
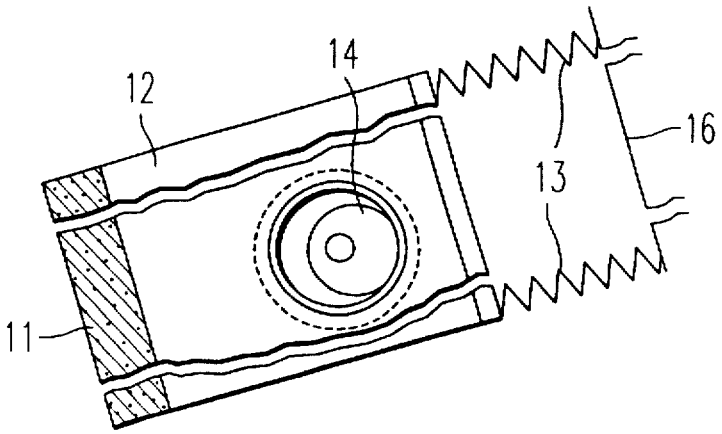
FIG. 5 is a view from above of the supporting device for the holder of the embodiment illustrated in FIG. 4.

FIGS. 4 and 5 show a modified embodiment of a supporting device for the holder 12. In FIGS. 4 and 5, the holder 12 is moved by an eccentric cam 14 which is supported by a supporting device 15 and springs 13 which are provided on a body of the image forming apparatus 16. The rotation of the eccentric cam 14 by a motor through gears (not illustrated) results in a reciprocating motion of the holder 12 and spreading blade 11 such that the holder 12 moves towards and away from the charging roller 1 along a plane which is substantially parallel to a plane tangent to the cylindrical surface of the charging roller. Further, the eccentric cam 14 rotates in a plane which is substantially parallel to the holder 12 and blade 11. The direction of the reciprocating motion is indicated by an arrow H in FIG. 4. In this embodiment, since different portions of the spreading blade 11 are held in contact with the charging roller 1, the spreading blade 11 has a long lifetime and provides a more uniform spreading action.

Figure 6:
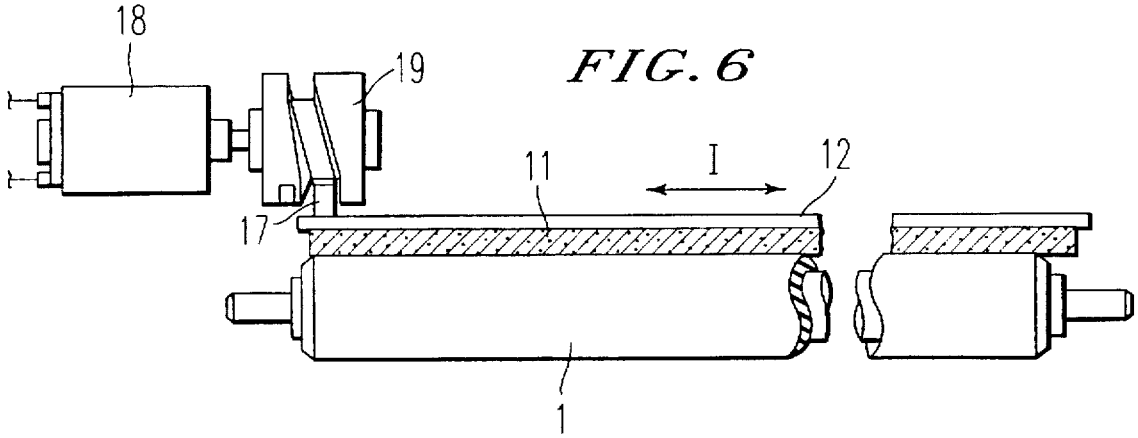
FIG. 6 is a cross-sectional view of a supporting device for a spreading device which moves the spreading blade in a reciprocating motion along the length of the charging roller.

FIG. 6 illustrates another embodiment of a device for moving the holder 12 and the spreading blade 11. In FIG. 6, a protrusion 17 is provided on or connected to the holder 12. The protrusion 17 is disposed in a groove of a cylindrical cam 19, also referred to as a barrel cam, which is a rotatable cylindrical member. The groove starts at one end of the cam 19, and after one-half of a revolution, the groove is at the other end of the cam 19, and after completing a complete rotation, the groove is back to the original position. As the cam 19 is rotated by a motor 18, the protrusion 17 moves within the groove which moves the holder 12 and the spreading blade 11 back and forth in a reciprocating direction I along a line which is parallel to a length of the charging roller. The movement imposed by the rotation of the cam 19 results in the spreading of the toner which is adhered to the surface of the charging roller 1 not only in the rotating direction of the charging roller 1 but also along the longitudinal direction of the charging roller 1. This reciprocating movement results in a uniform spreading of the toner which adheres to the charging roller 1.

Figure 7A:
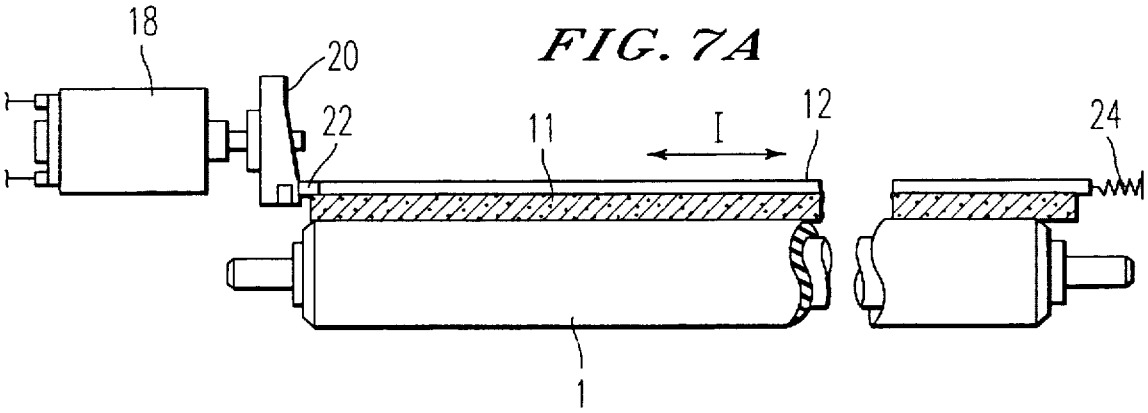
FIGS. 7A and 7B illustrate a modified embodiment of a device utilized to move the spreading blade in a reciprocating motion along the length of the charging roller.
Figure 7B:
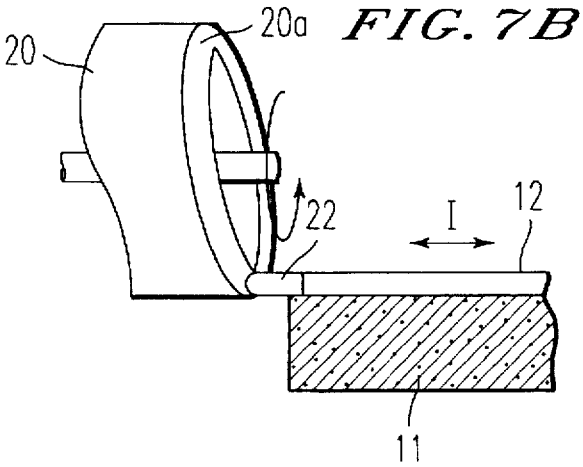

FIG. 7A is a side view, and FIG. 7B is a perspective view of an embodiment which also moves the spreading blade 11 reciprocally along a line I which is parallel to a length of the charging roller. There is a flat cam 20, also referred to as a single edge cylinder cam, which is a rotatable member having a circular or ring-like contact surface 20*a* which has a substantially constant radius and is tilted with respect to an axis of rotation of the motor 18. A spring 24 keeps the holder 12 urged against the flat cam 20. As the flat cam 20 rotates due to the motor 18, a circular contact surface 20*a* illustrated in FIG. 7B pushes on a contact portion 22 which is connected to the holder 12 which moves the holder 12 and spreading blade 11 move back and forth along a line or plane parallel to a length of the charging roller. The circular contact surface 20*a* appears to be circular when viewed along its axis of rotation. However, its actual shape may be oval. While a ring-like contact surface 20*a* has been illustrated in FIG. 7B, alternatively the surface 20*a* is not ring-like but is a solid surface. However, the functional effect is the same as the effect achieved by the ring-like contact surface 20*a* illustrated in FIG. 7B.

Figure 8A:
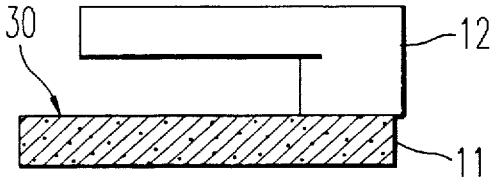
FIGS. 8A and 8B illustrate a preferred embodiment of the holder and spreading blade with a thin flexible film mounted between the holder and spreading blade.
Figure 8B:
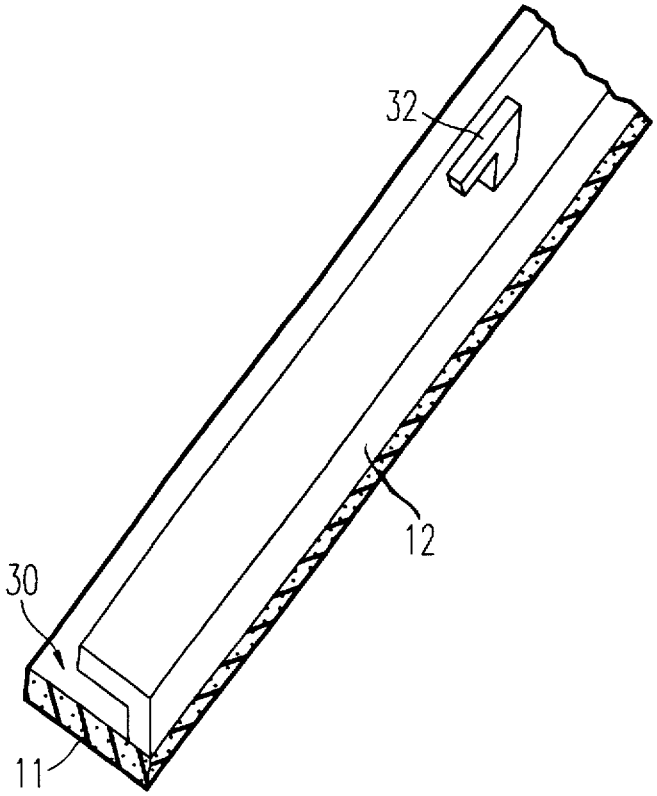

FIGS. 8A and 8B illustrate an actual implementation of the invention. The holder 12 is made of a relatively rigid plastic or resin and the spreading blade 11 is made of a polyurethane foam. There is also a thin film 30 which is adhesively connected to the top of the spreading blade 11 and the bottom of the holder 12. The thickness of the thin film 30 is approximately 100 μm and it is preferable to have the film 30 less than 1 mm thick and even more preferably to be less than 300 μm thick. The film 30 is a PET film which is polyethylene terephthalate. The film 30 is utilized to provide some rigidity and support to the spreading blade 11 along the entire width of the spreading blade 11. However, the film 30 is also flexible and allows the spreading blade to bend. Further, the film 30 may be used in any of the embodiments of the invention. Any desired type of adhesive or glue can be used to attach the film 30 to the spreading blade 11 and the holder 12.

The cross-sectional width of the spreading blade 11 is approximately one-half of an inch, the thickness of the spreading blade is approximately 3/32 of an inch, the approximate width of the top section of the holder 12 is approximately 7/16 of an inch, and the approximate width of the holder 12 which contacts the film 30 is 5/32 of an inch. While the word blade has been used to describe the spreading blade 11, there is no requirement to have the blade sharpened at one end and may have a rectangular cross-section, as illustrated in the drawings. The spreading blade preferably has a width which is greater than its thickness, more preferably has a width which is at least twice as great as its thickness, even more preferably at least four times as great as its thickness, for example.

FIG. 8B illustrates a perspective view of the holder 12, thin film 30, and spreading blade 11. Mounted to the top portion of the holder 12 is a hooking member 32 which points towards the end of the spreader unit. FIG. 8B illustrates approximately one-third of the entire spreader unit and there is a corresponding holder 32 on the other side of the spreader unit which is not illustrated which points in the same direction as the holder 32. The holder 32 is utilized to support the holder 12 in a holding assembly by a sliding motion used to engage the holding assembly with the holders 32.

Figure 9A:
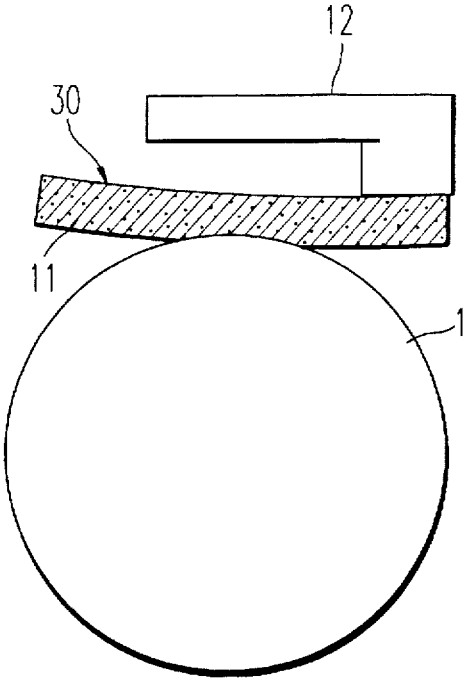
FIGS. 9A and 9B illustrate two different positions at which the spreading blade of FIGS. 8A and 8B can be mounted relative to the position of the charging roller.
Figure 9B:
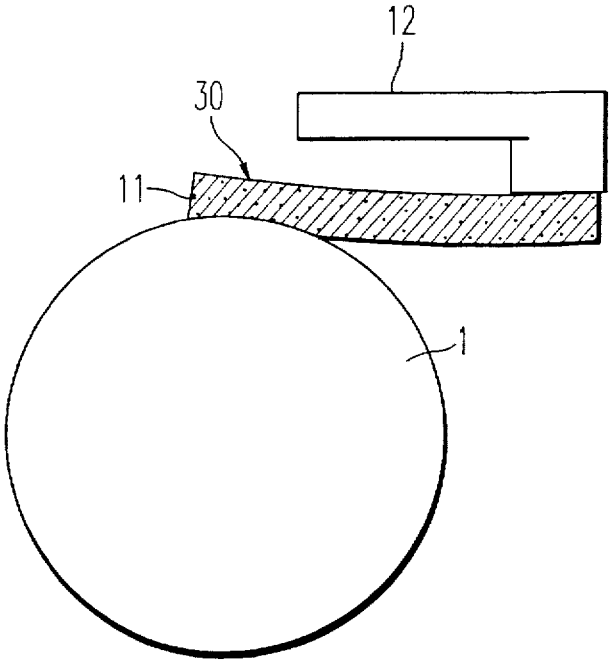

FIGS. 9A and 9B illustrate two different arrangements of the spreading blade 11 with respect to the charging roller 1. In FIG. 9A, the spreading blade 11 is approximately centered with respect to the charging roller 1. In FIG. 9B, the free end of the spreading blade 11 is at the contact point of the spreading blade 11 with the charging roller 1. Either one of these arrangements may be utilized or an arrangement in which the spreading blade 11 is between the two positions illustrated in FIGS. 9A and 9B may be utilized.

Figure 10:
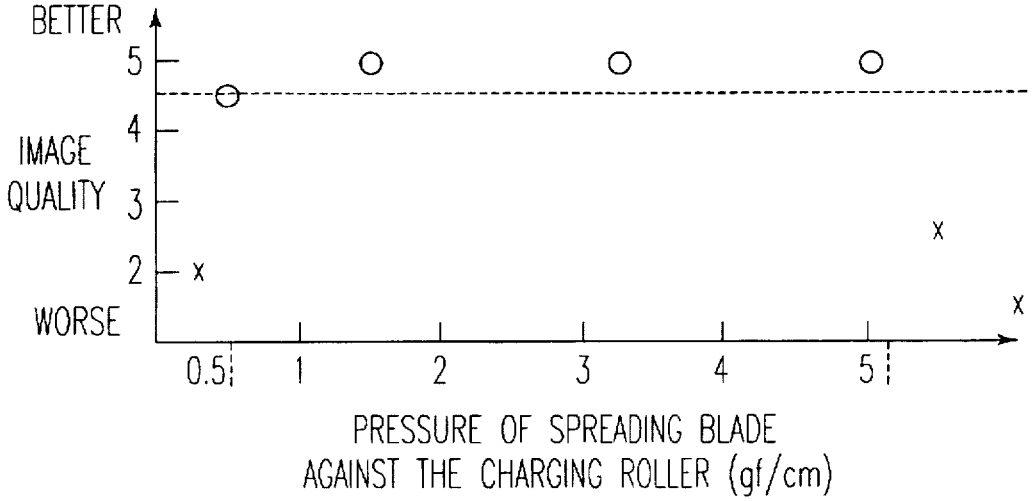
FIG. 10 illustrates the image quality which results from different pressures of the spreading blade of the present invention against the charging roller.

FIG. 10 illustrates the image quality which results from different pressures of the spreading blade against the charging roller. In FIG. 10, the broken horizontal line having an image quality of 4.5 is a threshold determined by the inventors below which the resulting image quality is considered to be unacceptable. The circles in FIG. 10 represent acceptable image quality and each X represents unacceptable image quality. In FIG. 10, a pressure of less than 0.5 grams force/cm allows toner to pass under the spreading blade 11 without being properly spread. A pressure greater than 5 gram force/cm was too great as this pressure caused the filming phenomenon described in the Background section to occur. Therefore, the preferable pressure of the spreading blade 11 against the charging roller 1 is between and including 0.5 and 5.0 g·f/cm. While this pressure is the preferable pressure utilized with the invention, other pressures can be utilized depending on different factors including the composition of the toner, material of the spreading blade 11, rotational speed of the charging roller 1, and any other factor. Therefore, the preferred pressure is merely preferred and not absolutely required.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A charging device, comprising:

a charging roller which charges an image bearing member and rotates in a predetermined direction;

a holder, and a spreading blade having a contact surface and a width which is parallel to the contact surface, the width having a first end and a second end opposite to the first end, the first end being a free end which is unsupported and the second end being supported by the holder, the contact surface being held in contact with said charging roller to spread toner adhered to a surface of the charging roller when the charging roller rotates in the predetermined direction, wherein the holder supports said spreading blade at the second end so that a frictional force acting on the spreading blade, which results from contact between the charging roller and spreading blade when the charging roller rotates in the predetermined direction, urges the spreading blade away from the holder.

2. A device according to claim 1, wherein:

said holder supports said spreading blade at an acute angle having a vertex at a point of contact of the spreading blade and the charging roller, the acute angle having one side formed by the spreading blade and another side formed by a line which is tangent to the charging roller at the vertex and extends over an unspread portion of the charging roller.

3. A device according to claim 1, wherein:

a force of the spreading blade against the charging roller when the charging roller is rotating in the predetermined direction is less than a force of the spreading blade against the charging roller when the charging roller is not rotating.

4. A device according to claim 1, further comprising:

a device which moves the holder and the spreading blade in a reciprocating motion such that the holder moves towards and away from the charging roller along a plane substantially parallel to a plane tangent to a cylindrical surface of the charging roller.

5. A device according to claim 4, wherein the device which moves the holder comprises:

an eccentric cam which rotates in a plane substantially parallel to the blade.

6. A device as claimed in claim 1, further comprising:

a device which moves the holder and the spreading blade back and forth along a line parallel to a length of the charging roller.

7. A device according to claim 6, wherein the device which moves the holder and the spreading blade back and forth comprises:

a rotatable cylindrical member having a spiral groove therein; and a protrusion, connected to the holder, disposed within the spiral groove.

8. A device according to claim 6, wherein the device which moves the holder and the spreading blade back and forth comprises:

a rotatable member having a circular contact surface which has a substantially constant radius and is tilted with respect to an axis of rotation of the rotatable member; and a contact portion, connected to the holder, which contacts the circular contact surface of the rotatable member.

9. A device according to claim 1, wherein:

said spreading blade is made of polyurethane foam.

10. A device according to claim 1, wherein:

a pressure of said spreading blade against the charging roller is between 0.5 and 5 gf/cm.

11. A device according to claim 1, further comprising:

a flexible film having an area which is substantially equal to an area of a contact surface side of the spreading blade which includes the contact surface, the flexible film mounted between the holder and the spreading blade such that the flexible film contacts only one side of the spreading blade.

12. A device according to claim 11, wherein:

more than one half of a width of the flexible film is free from contacting the holder.

13. A device according to claim 11, wherein:

a portion of the spreading blade which contacts the charging roller has a corresponding portion which contacts the flexible film at a position of the flexible film which is free from the holder.

14. A device according to claim 11, wherein:

the flexible film is less than 1 mm thick.

15. A device according to claim 14, wherein:

the flexible film is less than 300 μm thick.

16. A device according to claim 11, further comprising:

an adhesive between the flexible film and the spreading blade which holds the flexible film and spreading blade together.

17. A device according to claim 1, wherein:

the spreading blade has a length which is longer than the width and a height which is less than the width, and the contact surface is in a plane parallel to a plane defined by the length and the width.

18. A device according to claim 17, wherein the contact surface is the only surface of the blade which contacts the charging roller.

19. A device according to claim 1, further comprising:

a flexible film adhesively fixed to the spreading blade for providing rigidity and support to the spreading blade.

20. An image forming device for forming a toner image on a sheet of paper, comprising:

a photoconductive member;

a charging roller which charges the photoconductive member and rotates in a predetermined direction;

a holder, and a spreading blade having a contact surface and a width which is parallel to the contact surface, the width having a first end and a second end opposite to the first end, the first end being a free end which is unsupported and the second end being supported by the holder, the contact surface being held in contact with said charging roller to spread toner adhered to a surface of the charging roller when the charging roller rotates in the predetermined direction, wherein the holder supports said spreading blade at the second end so that a frictional force acting on the spreading blade, which results from contact between the charging roller and spreading blade when the charging roller rotates in the predetermined direction, urges the spreading blade away from the holder.

21. A device according to claim 20 wherein:

said holder supports said spreading blade at an acute angle having a vertex at a point of contact of the spreading blade and the charging roller, the acute angle having one side formed by the spreading blade and another side formed by a line which is tangent to the charging roller at the vertex and extends over an unspread portion of the charging roller.

22. A device according to claim 20, wherein:

a force of the spreading blade against the charging roller when the charging roller is rotating in the predetermined direction is less than a force of the spreading blade against the charging roller when the charging roller is not rotating.

23. A device according to claim 20, further comprising:

a device which moves the holder and the spreading blade in a reciprocating motion such that the holder moves towards and away from the charging roller along a plane substantially parallel to a plane tangent to a cylindrical surface of the charging roller.

24. A device according to claim 23, wherein the device which moves the holder comprises:

an eccentric cam which rotates in a plane substantially parallel to the blade.

25. A device as claimed in claim 20, further comprising:

a device which moves the holder and the spreading blade back and forth along a line parallel to a length of the charging roller.

26. A device according to claim 25, wherein the device which moves the holder and the spreading blade back and forth comprises:

a rotatable cylindrical member having a spiral groove therein; and a protrusion, connected to the holder, disposed within the spiral groove.

27. A device according to claim 25, wherein the device which moves the holder and the spreading blade back and forth comprises:

a rotatable member having a circular contact surface which has a substantially constant radius and is tilted with respect to an axis of rotation of the rotatable member; and a contact portion, connected to the holder, which contacts the circular contact surface of the rotatable member.

28. A device according to claim 20, wherein:

said spreading blade is made of polyurethane foam.

29. A device according to claim 20, wherein:

a pressure of said spreading blade against the charging roller is between 0.5 and 5 gf/cm.

30. A device according to claim 20, further comprising:

a flexible film having an area which is substantially equal to an area of a contact surface side of the spreading blade which includes the contact surface, the flexible film mounted between the holder and the spreading blade such that the flexible film contacts only one side of the spreading blade.

31. A device according to claim 30, wherein:

more than one half of a width of the flexible film is free from contacting the holder.

32. A device according to claim 30, wherein:

a portion of the spreading blade which contacts the charging roller has a corresponding portion which contacts the flexible film at a position of the flexible film which is free from the holder.

33. A device according to claim 30, wherein:

the flexible film is less than 1 mm thick.

34. A device according to claim 33, wherein:

the flexible film is less than 300 μm thick.

35. A device according to claim 30, further comprising:

an adhesive between the flexible film and the spreading blade which holds the flexible film and spreading blade together.

36. A device according to claim 20, wherein:

the spreading blade has a length which is longer than the width and a height which is less than the width, and the contact surface is in a plane parallel to a plane defined by the length and the width.

37. A device according to claim 36, wherein the contact surface is the only surface of the blade which contacts the charging roller.

38. A device according to claim 20, further comprising:

a flexible film adhesively fixed to the spreading blade for providing rigidity and support to the spreading blade.

39. An image forming device for forming a toner image on a sheet of paper, comprising:

a photoconductive member;

a charging roller which charges the photoconductive member and rotates in a predetermined direction;

a holder means; and a spreading means having a contact surface and a width which is parallel to the contact surface, the width having a first end and a second end opposite to the first end, the first end being a free end which is unsupported and the second end being supported by the holder means, the contact surface being held in contact with said charging roller for spreading toner adhered to a surface of the charging roller when the charging roller rotates in the predetermined direction, wherein the holder means is for supporting said spreading means at the second end so that a frictional force acting on the spreading means, which results from contact between the charging roller and spreading means when the charging roller rotates in the predetermined direction, urges the spreading means away from the holder means.

40. A device according to claim 39, further comprising:

means for moving the holder means and the spreading means in a reciprocating motion such that the holder means moves towards and away from the charging roller along a plane substantially parallel to plane tangent to a cylindrical surface of the charging roller.

41. A device as claimed in claim 39, further comprising:

means for moving the holder means and the spreading means back and forth along a line parallel to a length of the charging roller.

42. A device according to claim 39, wherein:

said spreading means is a blade made of polyurethane foam.

43. A device according to claim 39, wherein:

a pressure of said spreading means against the charging roller is between 0.5 and 5 gf/cm.

44. A device according to claim 39, further comprising:

a flexible film means for supporting the spreading means, the flexible film means having an area which is substantially equal to an area of a contact surface side of the spreading means which includes the contact surface, the flexible film means mounted between the holder means and the spreading means such that the flexible film means contacts only one side of the spreading means.

45. A device according to claim 44, further comprising:

an adhesive between the flexible film means and the spreading means which holds the flexible film means and spreading means together.

46. A device according to claim 39, wherein:

the spreading means has a length which is longer than the width and a height which is less than the width, and the contact surface is in a plane parallel to a plane defined by the length and the width.

47. A device according to claim 46, wherein the contact surface is the only surface of the spreading means which contacts the charging roller.

48. A device according to claim 39, further comprising:

a flexible film means adhesively fixed to the spreading means for providing rigidity and support to the spreading means.

* * * * *

UNITED STATES PATENT AND TRADEMARK OFFICE

CERTIFICATE OF CORRECTION

PATENT NO. : 5,799,229

DATED : August 25, 1998

INVENTOR(S) : Masato YOKOYAMA, et al.

It is certified that error appears in the above-identified patent and that said Letters Patent is hereby corrected as shown below:

On the title page, Item [30], the Foreign Application Data, is incorrect. It should read:

--Mar.11, 1996 [JP] Japan.....8-083116--

Signed and Sealed this

Twenty-third Day of March, 1999

*Attest:*

*Attesting Officer*

Q. TODD DICKINSON

*Acting Commissioner of Patents and Trademarks*